US010293404B2

(12) United States Patent
Kao

(10) Patent No.: US 10,293,404 B2
(45) Date of Patent: May 21, 2019

(54) FULL-SERVO MULTI-AXIS DIE-CASTING MACHINE

(71) Applicant: T-SOK CO., LTD., New Taipei (TW)

(72) Inventor: Kun-Szu Kao, New Taipei (TW)

(73) Assignee: T-SOK CO., LTD., New Taipei (TW)

( * ) Notice: Subject to any disclaimer, the term of this patent is extended or adjusted under 35 U.S.C. 154(b) by 123 days.

(21) Appl. No.: 15/475,148

(22) Filed: Mar. 31, 2017

(65) Prior Publication Data

US 2018/0281059 A1 Oct. 4, 2018

(51) Int. Cl.
*B22D 17/20* (2006.01)
*B22D 17/32* (2006.01)

(52) U.S. Cl.
CPC ..... *B22D 17/2061* (2013.01)

(58) Field of Classification Search
CPC ..... B22D 17/00; B22D 17/20; B22D 17/26; B22D 17/30; B22D 17/32; B22D 17/2015; B22D 17/2061
USPC ..... 164/303, 312, 316, 341, 342
See application file for complete search history.

(56) References Cited

U.S. PATENT DOCUMENTS

2011/0052742 A1* 3/2011 Kuga et al. ..... B29C 45/6728 425/149
2014/0353340 A1* 12/2014 Ikeda et al. ..... B22D 17/203 222/596
2015/0290705 A1* 10/2015 Nakatsuka ..... B22D 17/2015 164/312

* cited by examiner

*Primary Examiner* — Kevin P Kerns
(74) *Attorney, Agent, or Firm* — Leong C. Lei

(57) ABSTRACT

A full-servo multi-axis die-casting machine includes an injection device body, a gooseneck operation device body and a plurality of mold locking device bodies. The injection device body includes a hollow first frame, a first servomotor, a screw, a transmission unit and an injection unit, so that the screw is caused to rotate by the first servomotor and is converted by the transmission unit into vertical reciprocal movement. The gooseneck operation device body includes a second servomotor, a first transmission arm and a second transmission arm, so that the first transmission arm and the second transmission arm are driven by the second servomotor to allow bifurcation sections to oscillate with rotation of the transmission section. The mold locking device bodies each include a third servomotor, a third transmission arm and a mold retention slide block, so that the mold retention slide block is reciprocally movable in the channel.

10 Claims, 12 Drawing Sheets

FULL-SERVO MULTI-AXIS DIE-CASTING MACHINE

TECHNICAL FIELD OF THE INVENTION

The present invention relates generally to a structure of a die-casting machine, and more particularly to a full-servo multi-axis die-casting machine that uses servomotors as primary power sources.

DESCRIPTION OF THE PRIOR ART

Die casting is a process of casting that is achieved by filling metals having good property of melting and solidifying, such as aluminum, zinc, magnesium, and copper, through fast high pressure mechanical property, into a temperature-resistant metal mold and making use of a relatively low temperature of the steel mold to achieve fast cooling and solidification for shape fixing.

A regular hot-chamber die-casting machine generally comprises a base on which a mold is provided. The mold is provided, at one side thereof, with an injection port. A melting furnace is provided beside the base and a hydraulic cylinder is arranged above the melting furnace. The hydraulic cylinder is provided, on an end thereof, with an injection head that mates and is connectable with the injection port of the mold in order to allow fast high pressure mechanical property to be filled into the temperature-resistant metal mold. The conventional die-casting machine suffers certain drawbacks. For example, a pneumatic cylinder or a hydraulic cylinder is used as a power source and a moving stroke or speed cannot be controlled accurately. Calibration and tuning must be conducted based on experience. Further, the hydraulic cylinder often makes the working environment oily. Improvements are necessary for the conventional die-casting machine.

Thus, the technical issue that the present invention is made for is to overcome the above-discussed shortcomings.

SUMMARY OF THE INVENTION

In view of the above-discussed shortcomings, the present invention provides a full-servo multi-axis die-casting machine, which comprises: an injection device body, a gooseneck operation device body, and a plurality of mold locking device bodies. The injection device body comprises a hollow first frame, a first servomotor, a screw, a transmission unit and an injection unit, so that when the first servomotor is in operation, the screw is rotated and the transmission unit converts the rotation of the screw into vertical reciprocal movement. The gooseneck operation device body comprises a second servomotor, a first transmission arm, and a second transmission arm, so that when the second servomotor is in operation, the first transmission arm and the second transmission arm are driven to cause the transmission section to rotate such that the bifurcation sections are driven to oscillate frontwards and rearwards with the rotation of the transmission section. Each of the mold locking device bodies comprises a third servomotor, a third transmission arm, and a mold retention slide block, so that when the third servomotor is in operation, the third transmission arm is rotated and the third transmission arm drives the mold retention slide block to move such that the mold retention slide block is cause to reciprocate in the channel.

The purpose of the full-servo multi-axis die-casting machine according to the present invention is to replace a pneumatic cylinder or a hydraulic cylinder with a servomotor so that operation strokes are made more accurate without the need for manual correction and also without noise generated by a pneumatic cylinder and oiliness caused by a hydraulic cylinder, and also operation safety is enhanced to thereby provide efficacy of environmental protection, energy saving and humanization.

Further, the mold locking device bodies allow a mold to be split into four axial directions, making mold opening easy and providing flexibility in selecting a parting line, metal melt being allowed to be directly filled into the mold through the parting line, so that flow division structure used in the conventional die casting can be eliminated, cooling is made fast to thereby save energy, save material, and improve manufacturing speed.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings, identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Firstly, referring to FIGS. 1, 2, 3, 6, and 10, the present invention provides a full-servo multi-axis die-casting machine 1, which comprises: an injection device body 10, a gooseneck operation device body 20, and a plurality of mold locking device bodies 30.

Figure 1:
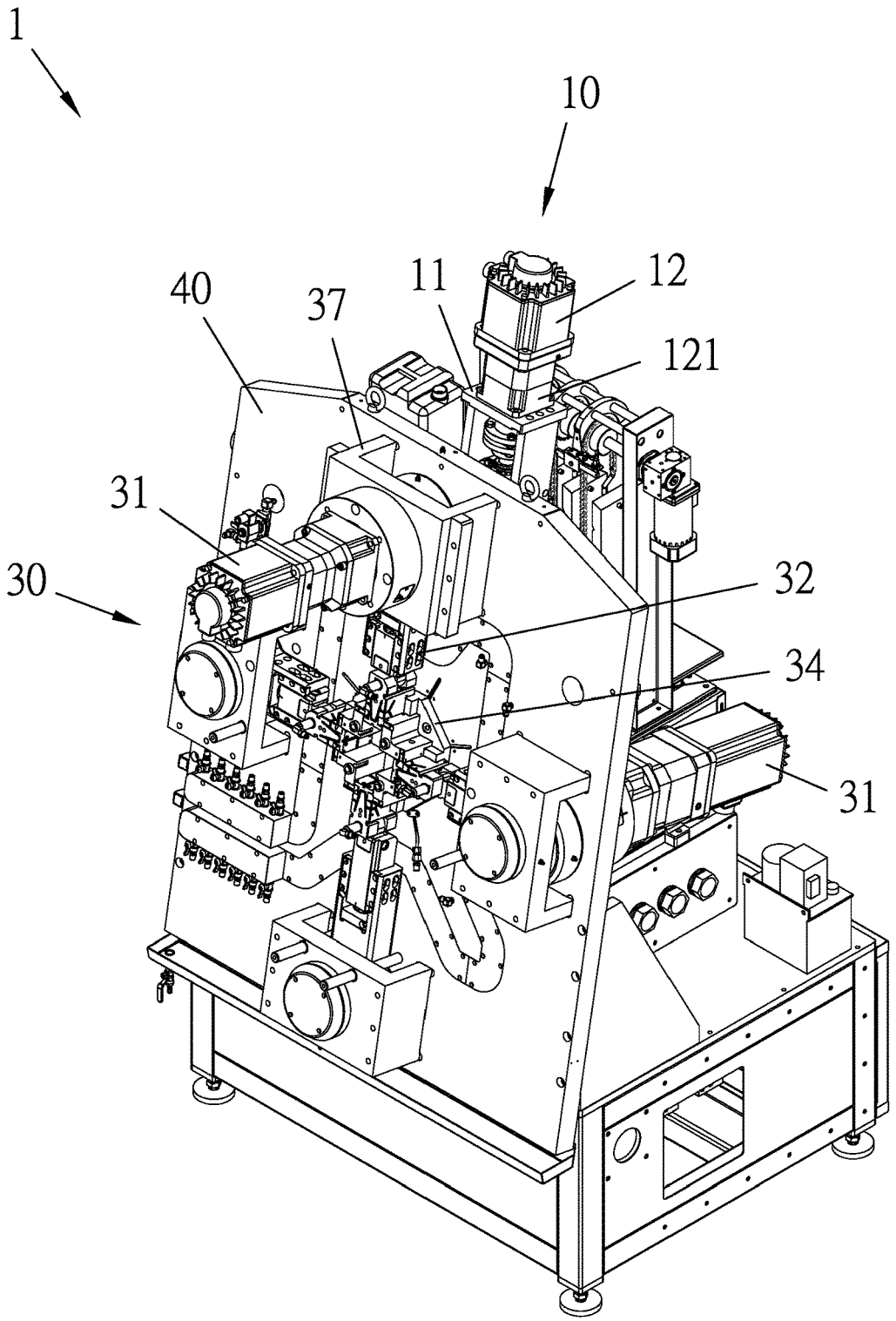
FIG. 1 is a perspective view of the present invention.
Figure 2:
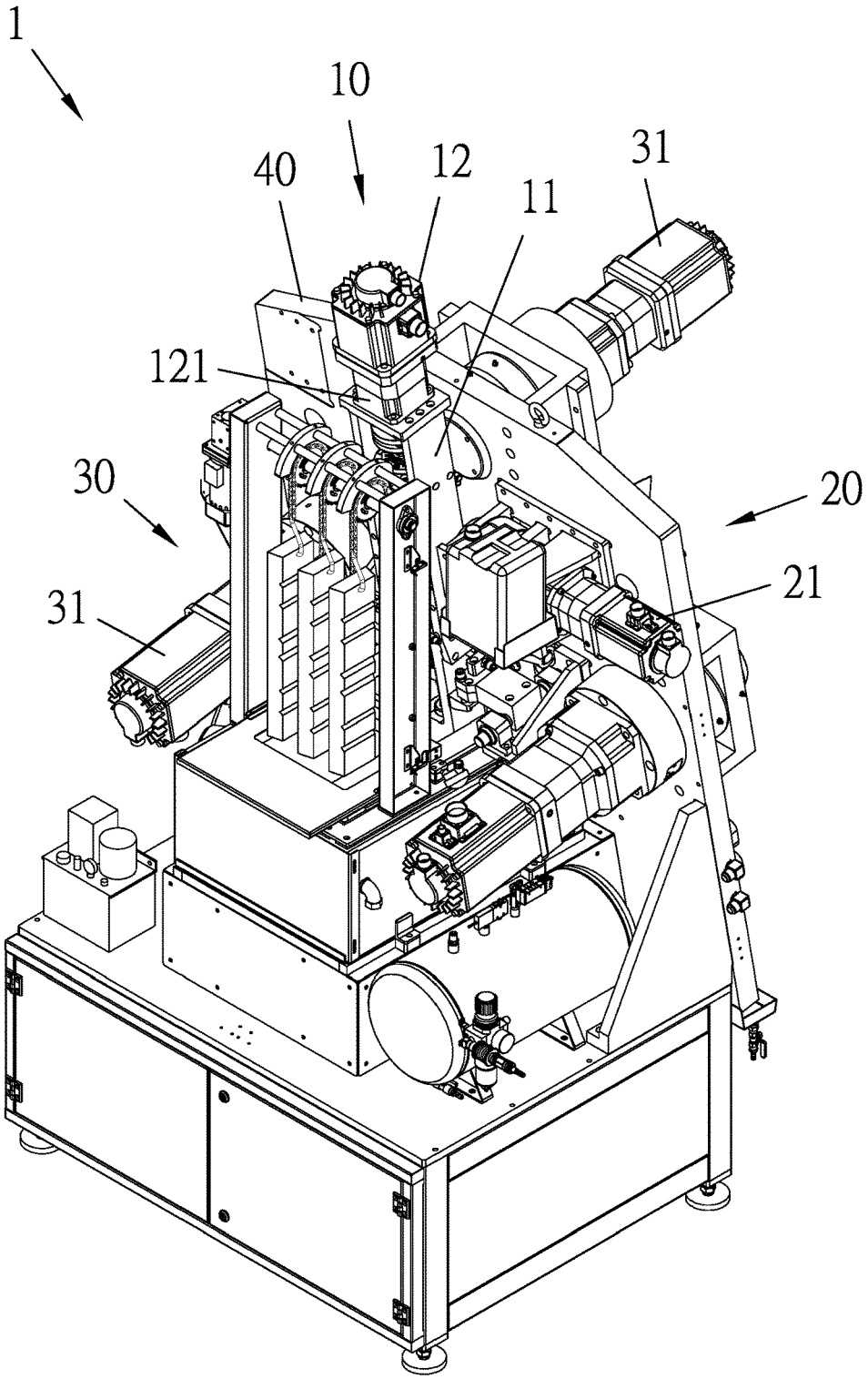
FIG. 2 is another perspective view of FIG. 1.
Figure 3:
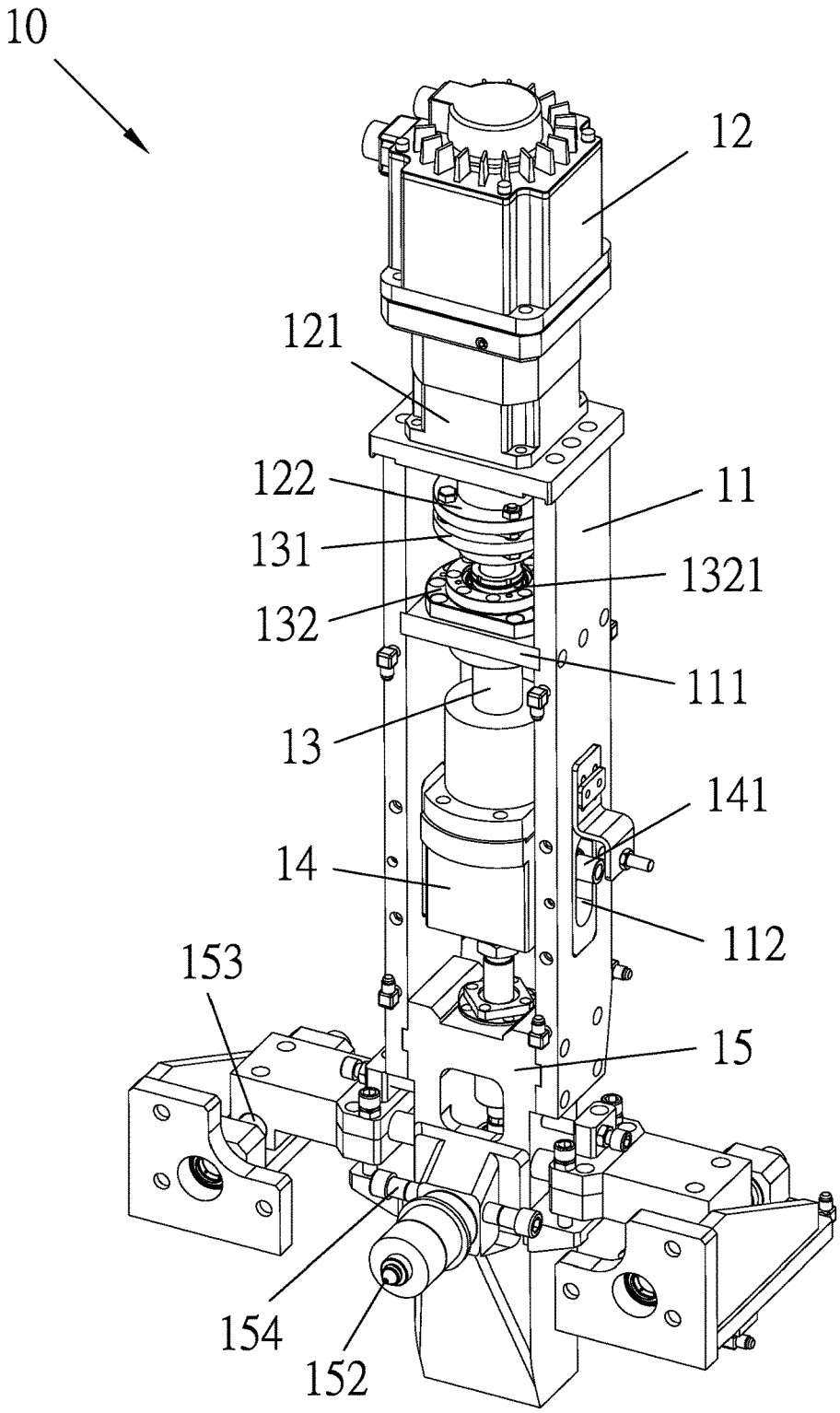
FIG. 3 is a perspective view of an injection device body of the present invention.
Figure 4:
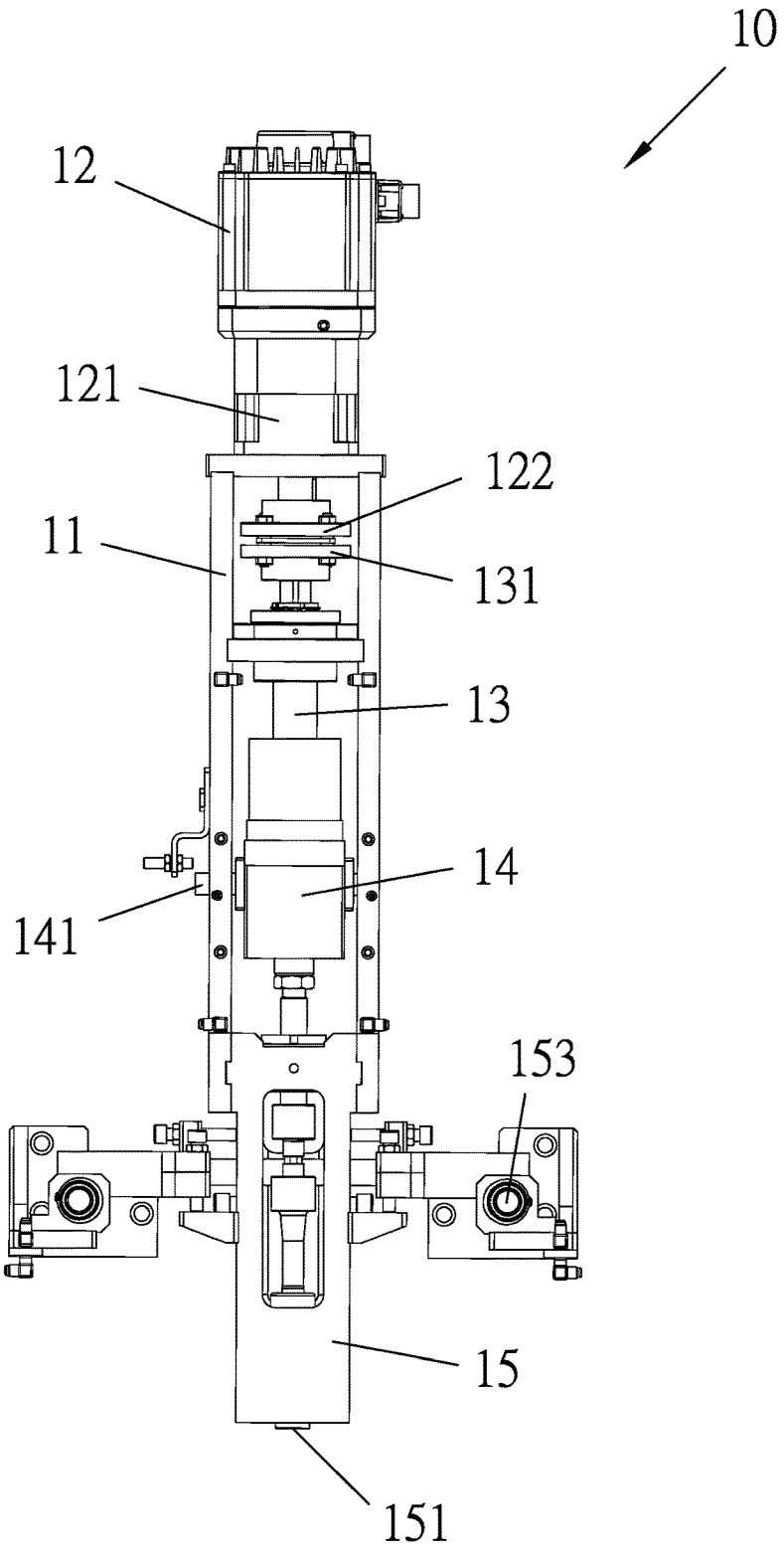
FIG. 4 is a front view of FIG. 3.
Figure 5:
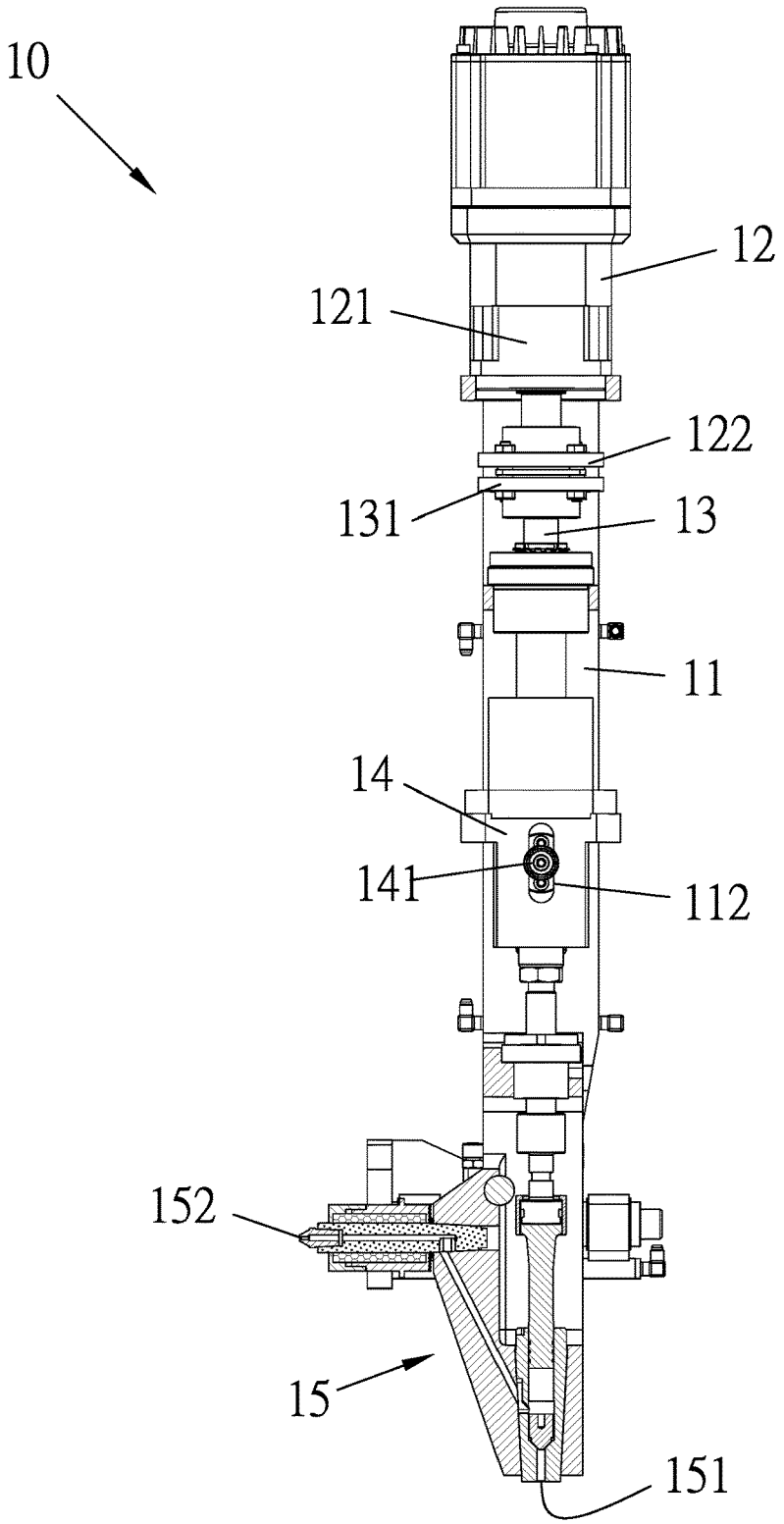
FIG. 5 is a cross-sectional view of the injection device body of the present invention.

Referring to FIGS. 3-5, the injection device body 10 is mounted to a surface of a standing board 40. The injection device body 10 comprises a hollow first frame 11, a first servomotor 12, a screw 13, a transmission unit 14, and an injection unit 15.

The first servomotor 12 is mounted to a top of the first frame 11. The first servomotor 12 has an end coupled to a first speed reduction mechanism 121. The first speed reduction mechanism 121 is coupled to one end of the screw 13. An opposite end of the screw 13 is coupled to the transmission unit 14. An opposite end of the transmission unit 14 is coupled to the injection unit 15. The injection unit 15 comprises at least one inlet port 151 and at least one outlet port 152. The injection unit 15 has two sides that are each slidably mounted on a guide rail 153. The injection unit 15 is also provided, on each of two sides thereof, with a coupling section 154 projecting therefrom. The standing board 40 comprises a first through hole 41 formed therein and the outlet port 152 of the injection unit 15 is received through the first through hole 41.

The standing board 40 comprises a first opening 42 and a second opening 43 mounted to a side surface thereof. The standing board 40 is provided therein with a cooling water channel 44 arranged as a loop. The cooling water channel 44 has two ends respectively communicating with the first opening 42 and the second opening 43.

The first speed reduction mechanism 121 and the one end of the screw 13 are respectively provided with a first fixing element 122 and a second fixing element 131, such that the first fixing element 122 is coupled to the second fixing element 131.

The first frame 11 is also provided therein with a separation plate 111. The separation plate 111 is formed with a first through aperture (not shown). The screw 13 extends through the first through aperture. The screw 13 is provided, on the end thereof, with a third fixing element 132. The third fixing element 132 is coupled to the separation plate 111 and the third fixing element 132 is provided therein with a bearing 1321.

The injection unit 15 is provided with a second through aperture (not shown) to receive the extension of the screw 13 therethrough. The inlet port 151 and the outlet port 152 are respectively formed on a bottom surface and a side of the injection unit 15.

The first frame 11 is provided, in a side thereof, with a constraint hole 112. The transmission unit 14 is provided, on a side thereof, with an engagement section 141 projecting therefrom such that the engagement section 141 is received through the constraint hole 112.

Figure 6:
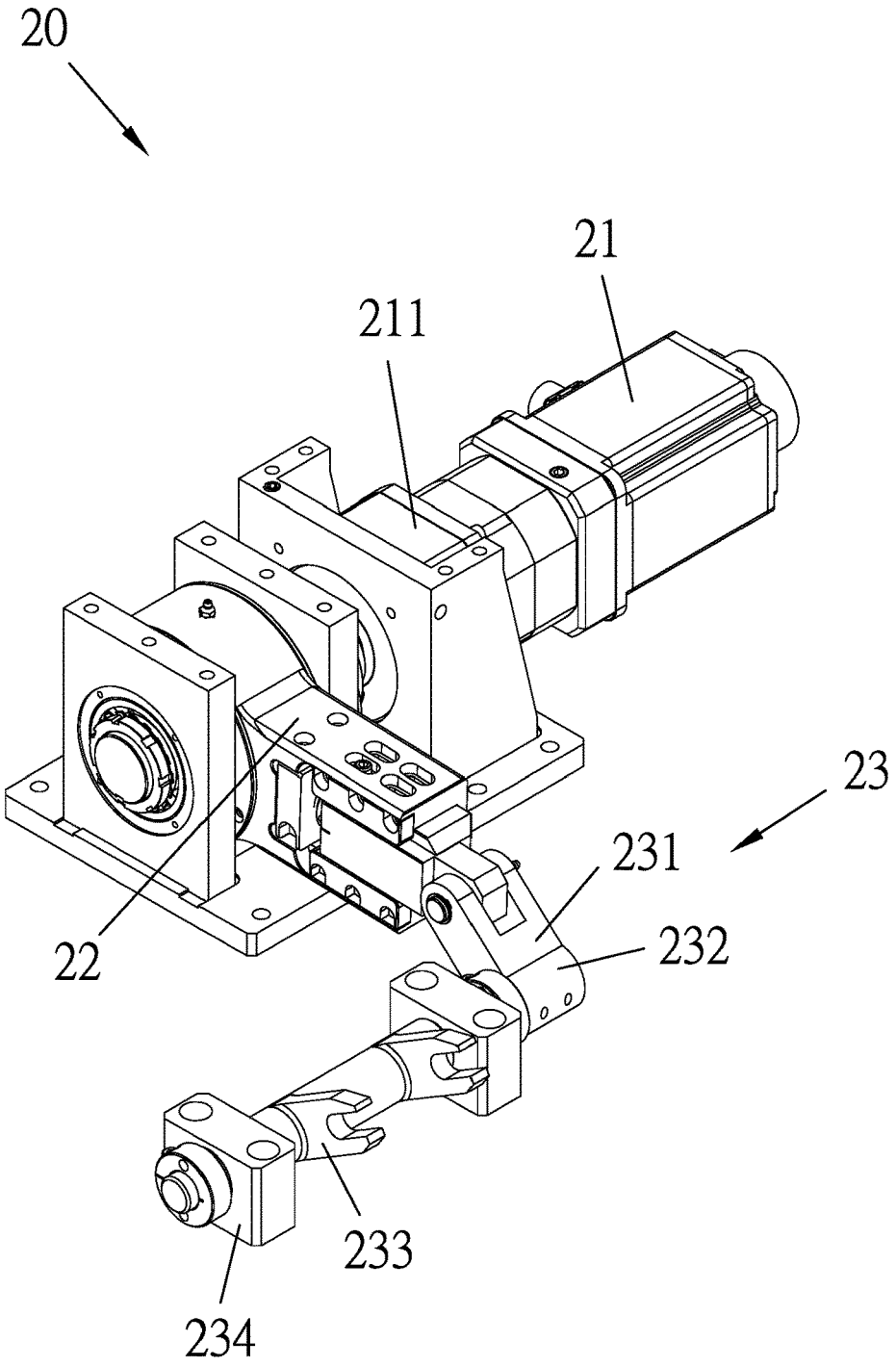
FIG. 6 is a perspective view of a gooseneck operation device body of the present invention.
Figure 7:
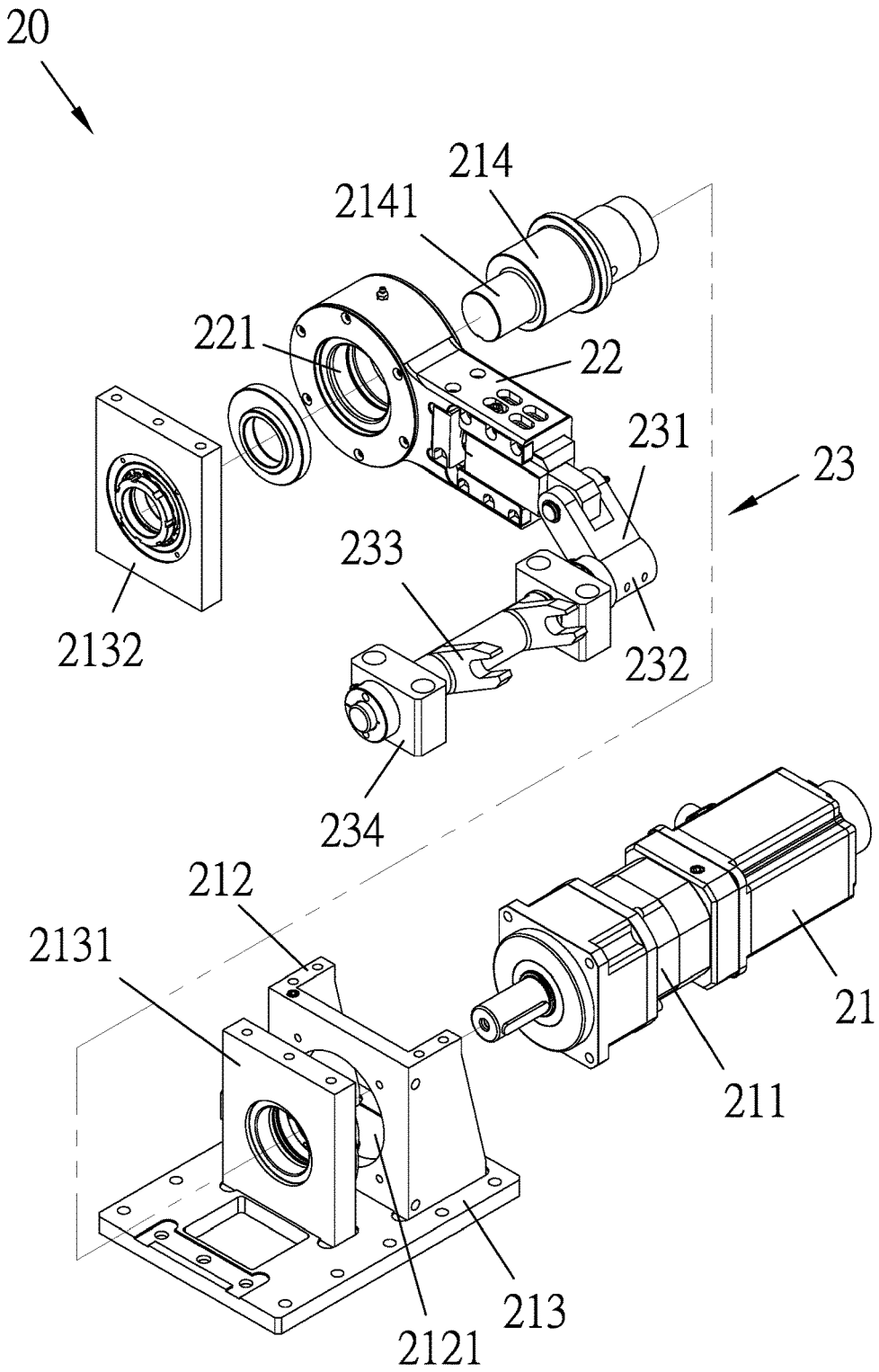
FIG. 7 is an exploded view of FIG. 6.

Referring to FIGS. 6-7, the gooseneck operation device body 20 is mounted on the standing board 40. The gooseneck operation device body 20 comprises a second servomotor 21, a first transmission arm 22, and a second transmission arm 23. The second servomotor 21 comprises a second speed reduction mechanism 211. An end of the first transmission arm 22 is formed with a first spindle hole 221. The second speed reduction mechanism 211 is rotatably coupled, in an eccentric manner, to the first spindle hole 221. The second transmission arm 23 comprises a rotatable joint section 231 and a transmission section 232. The rotatable joint section 231 and the transmission section 232 form therebetween a predetermined included angle and in the instant embodiment, the predetermined included angle is 90 degrees.

Figure 9:
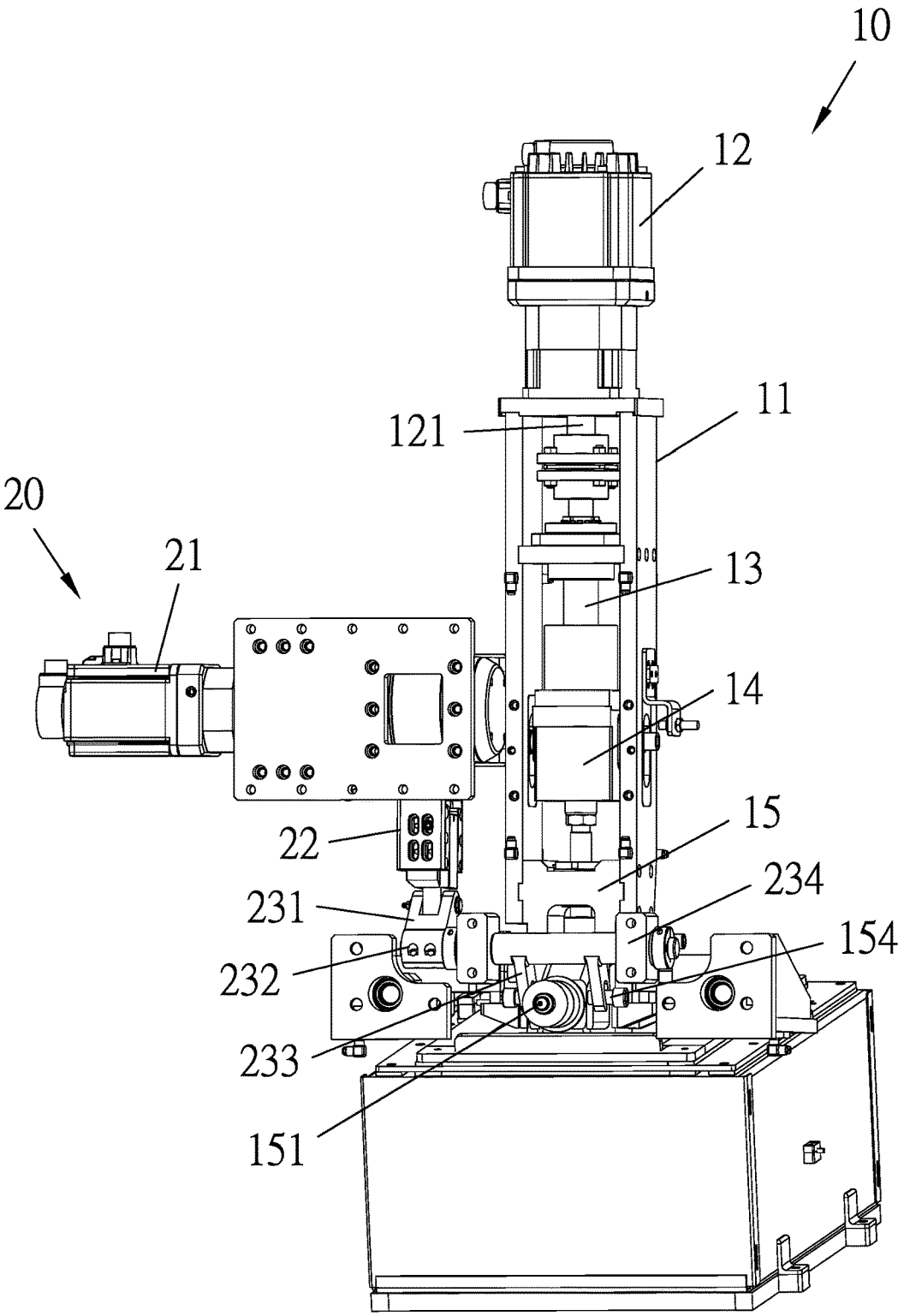
FIG. 9 is a perspective view showing the injection deice body combined with the gooseneck operation device body according to the present invention.

Referring to FIG. 9, the rotatable joint section 231 is rotatably mounted to an opposite end of the first transmission arm 22. The transmission section 232 is provided with at least two the bifurcation sections 233 and the bifurcation sections 233 are respectively fit over the coupling sections 154.

An end of the second servomotor 21 to which the second speed reduction mechanism 211 is mounted is coupled to a second frame 212. The second frame 212 is provided, at one side thereof, with a seat plate 213. The second frame 212 is formed with a third through aperture 2121 and the seat plate 213 is provided with a first spindle seat 2131 and a second spindle seat 2132. The third through aperture 2121 and the first spindle seat 2131 receive the second speed reduction mechanism 211 to extend therethrough. The second speed reduction mechanism 211 is coupled to a first eccentric element 214. An end of the first eccentric element 214 that is coupled to the second speed reduction mechanism 211 is rotatably mounted to the first spindle seat 2131 and an opposite end of the first eccentric element 214 is received through the first spindle hole 221. The first eccentric element 214 is provided, on an end face of said opposite end, with an eccentric shaft 2141 extending therethrough. The eccentric shaft 2141 is rotatably mounted to the second spindle seat 2132.

The transmission section is further provided thereon with two spaced coupling elements 234. The bifurcation sections 233 are located between the coupling elements 234 such that a predetermined distance is present between the bifurcation sections 233.

Figure 10:
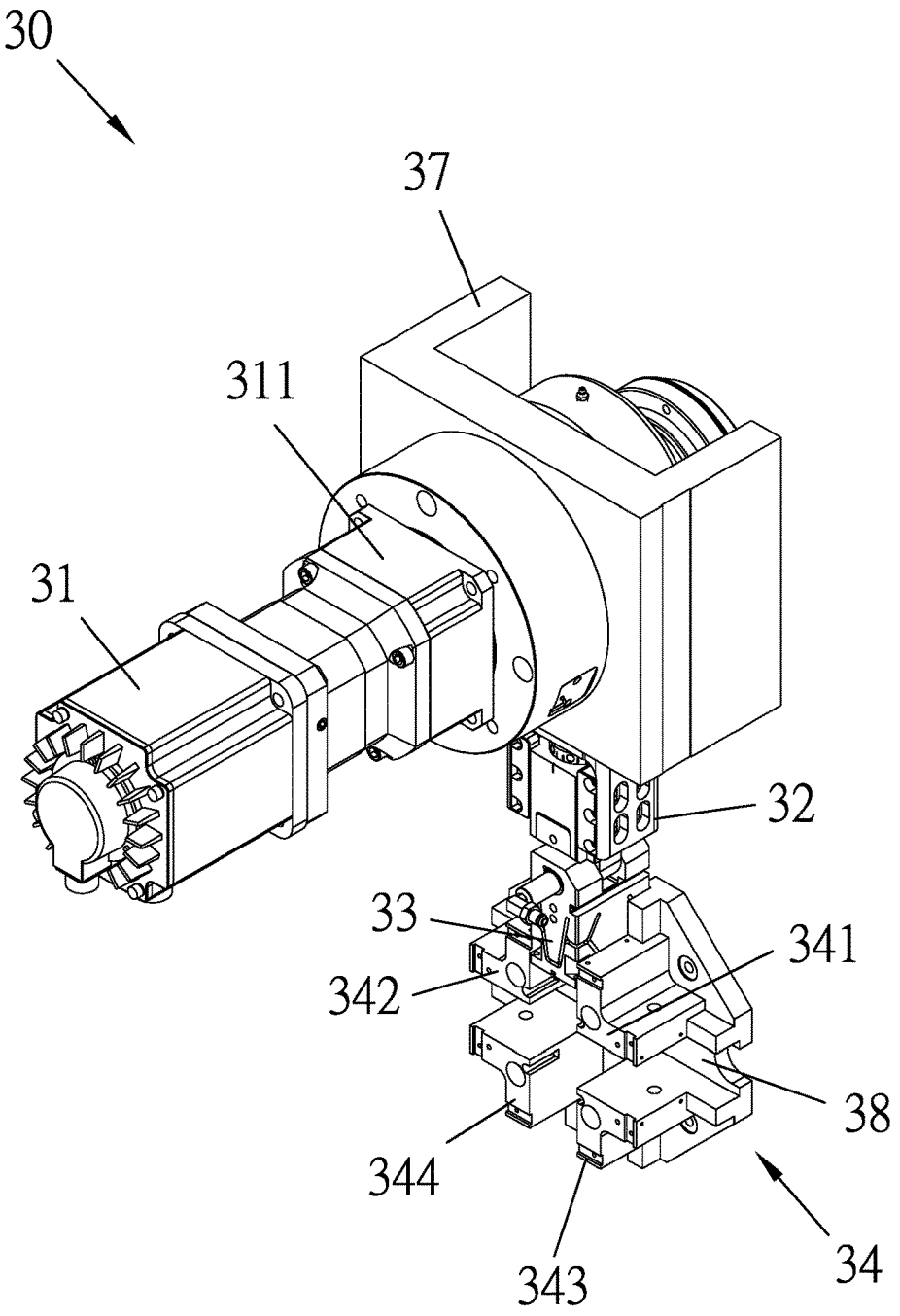
FIG. 10 is a perspective view of a mold locking device body of the present invention.
Figure 11:
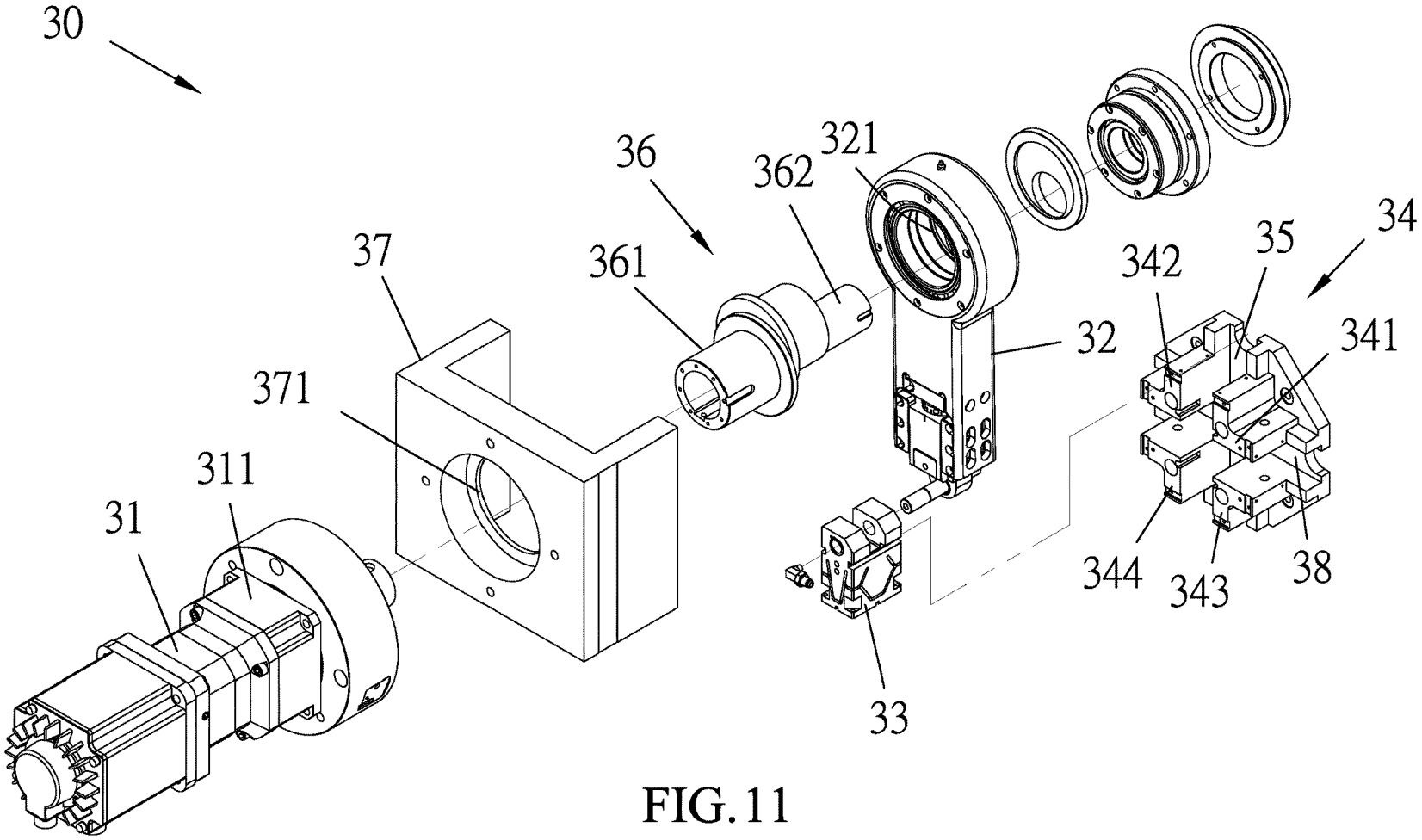
FIG. 11 is an exploded view of FIG. 10.
Figure 12:
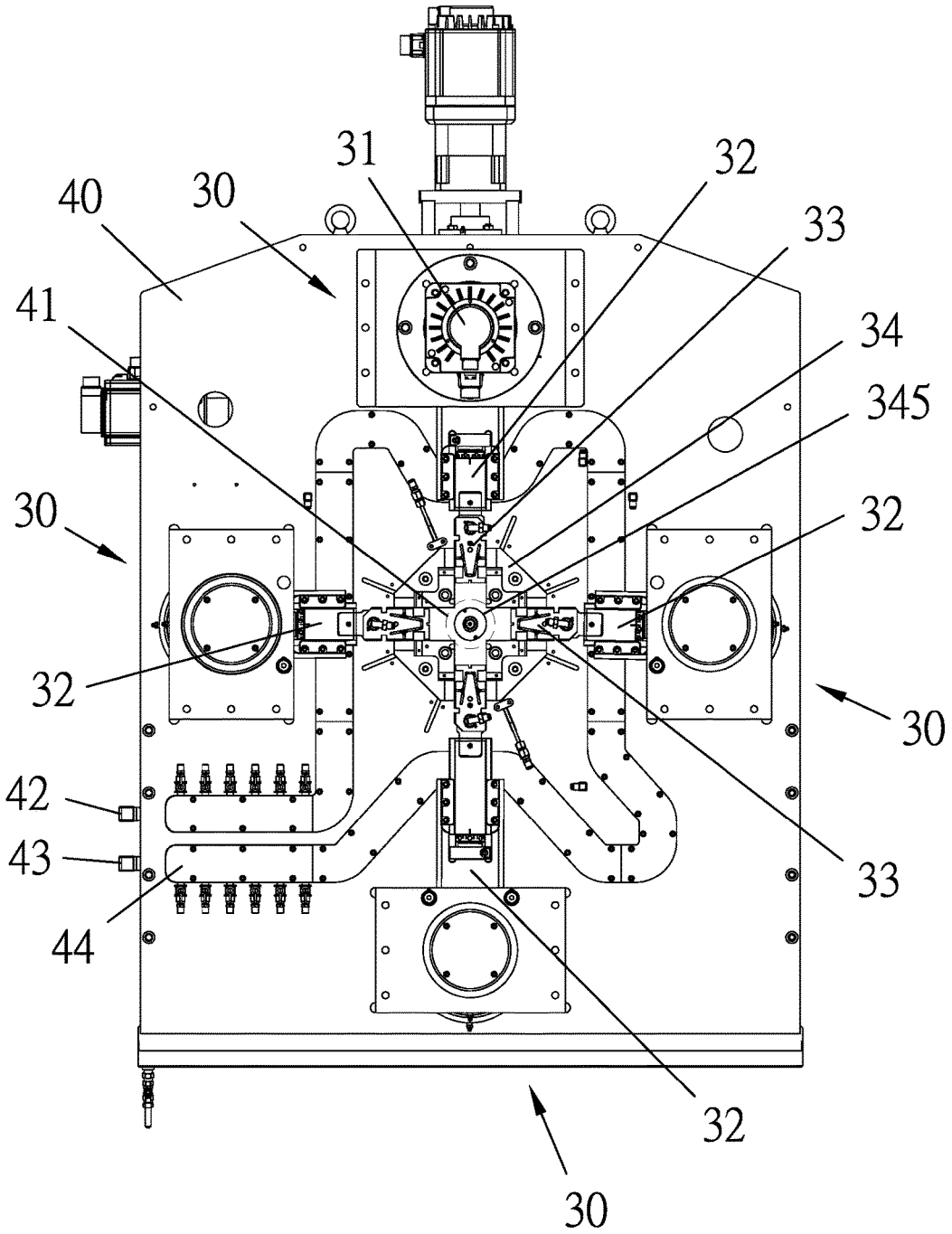
FIG. 12 is a front view of the mold locking device body of the present invention.

Referring to FIGS. 10-12, the mold locking device bodies 30 are mounted to an opposite surface of the standing board 40, respectively set at locations corresponding to upper, lower, left and right portions. Each of the mold locking device bodies 30 comprises a third servomotor 31, a third transmission arm 32, and a mold retention slide block 33.

An end of the third servomotor 31 is provided with a third speed reduction mechanism 311. The third speed reduction mechanism 311 is rotatably coupled, in an eccentric manner, to the third transmission arm 32. An opposite end of the third transmission arm 32 is rotatably coupled to the mold retention slide block 33. One end face of the mold retention slide block 33 is mounted, in a slidable manner, in a mold seat 34. The mold seat 34 comprises at least two projection sections 341, 342 and a channel 35 is formed between the projection sections 341, 342. The one end of the mold retention slide block 33 is slidably mounted in the channel 35. The mold seat 34 is provided with a second through hole 345 that is in communication with the first through hole 41 and the outlet port 152 is received through the second through hole 345.

The mold seat 34 is located in an area circumferentially surrounded by the cooling water channel 44 in order to reduce the temperature of the mold seat.

The third speed reduction mechanism 311 is further provided with a second eccentric element 36. The second eccentric element 36 has two ends respectively forming a first eccentric section 361 and a second eccentric section 362. The first eccentric section 361 and the second eccentric section 362 are arranged on the same axial line. The first eccentric section 361 is coupled to the third speed reduction mechanism 311. The third transmission arm 32 is provided with a second spindle hole 321 formed in an end of thereof. The second eccentric section 362 is mounted in the second spindle hole 321.

The third servomotor 31 is coupled to a third frame 37. The third frame 37 is provided with a fourth through aperture 371. The fourth through aperture 371 receives the third speed reduction mechanism 311 to extend therethrough.

With the above structure, when the first servomotor 12 is in operation, the screw 13 is rotated and the transmission unit 14 converts the rotation of the screw 13 into vertical reciprocal movement.

Figure 8:
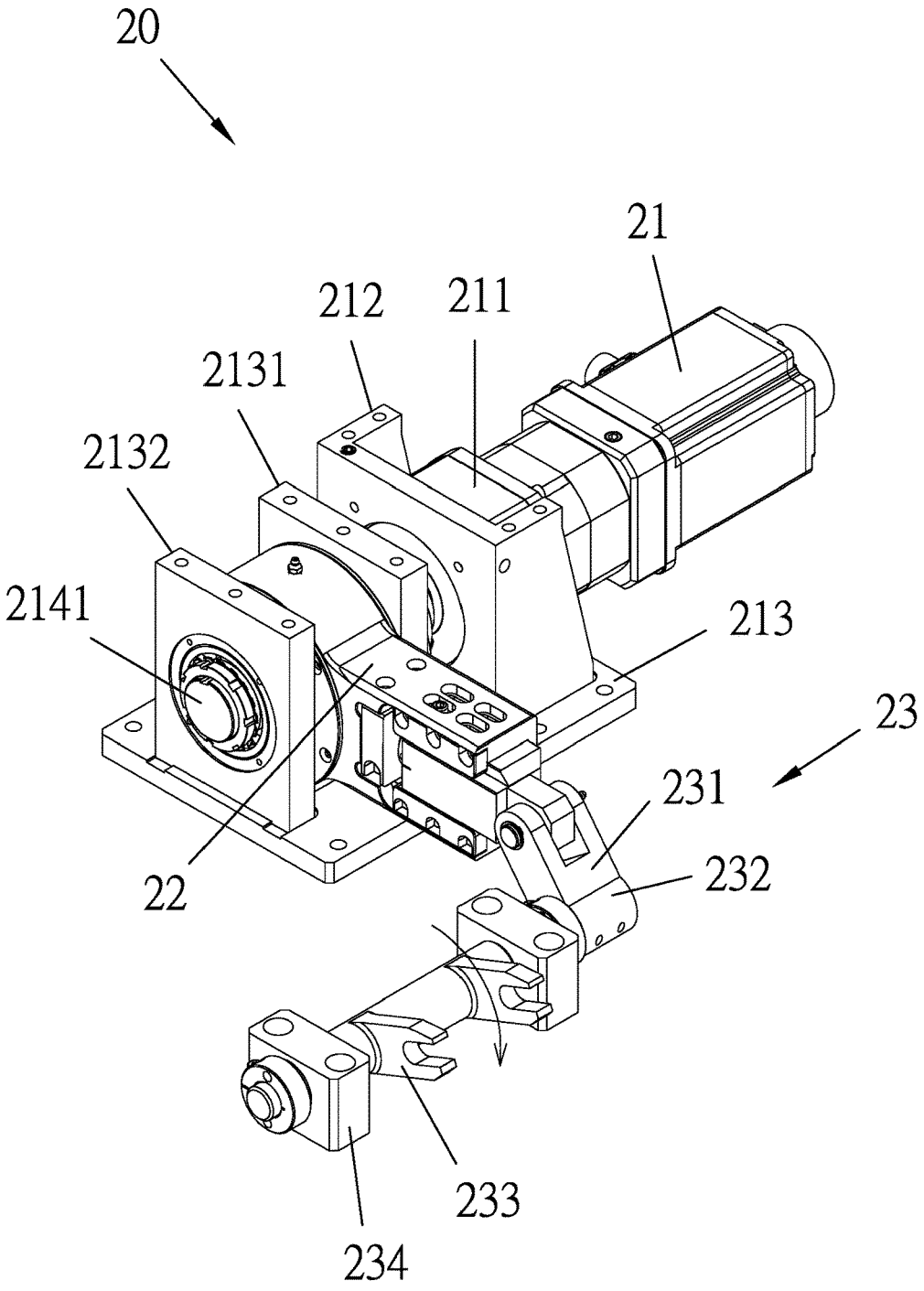
FIG. 8 is a perspective view demonstrating operation of the gooseneck operation device body of the present invention.

Referring to FIGS. 8 and 9, when the second servomotor 21 is in operation, the first transmission arm 22 and the second transmission arm 23 are driven to cause the transmission section 232 to rotate such that the bifurcation sections 233 are driven to oscillate frontwards and rearwards with the rotation of the transmission section 233 thereby driving the injection unit 15 to move along the guide rails 153.

Referring to FIGS. 1, 2, 10, and 12, when the third servomotor 31 is in operation, the third transmission arm 32 is rotated and the third transmission arm 32 drives the mold retention slide block 33 to move such that the mold retention slide block 33 is cause to reciprocate in the channel 35. In the instant embodiment, the standing board 40 is provided with four mold locking device bodies 30. The mold seat 34 comprises projection sections 341, 342, 343, 344. The projection sections 341, 342 comprise a channel 35 formed therebetween and the projection sections 343, 344 comprise a channel 35 formed therebetween; and the projection sections 341, 343 and the pair of the projection sections 342, 344 form therebetween a channel 38, such that the mold seat 34 is provided with a cross channel to receive the mold retention slide blocks 33 to slide therein.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A full-servo multi-axis die-casting machine, comprising:

an injection device body, which is mounted to a surface of a standing board, the injection device body comprising a hollow first frame, a first servomotor, a screw, a transmission unit, and an injection unit, wherein the first servomotor is mounted to a top of the first frame; the first servomotor has an end coupled to a first speed reduction mechanism; the first speed reduction mechanism is coupled to one end of the screw; an opposite end of the screw is coupled to the transmission unit; an opposite end of the transmission unit is coupled to the injection unit; the injection unit comprises at least one inlet port and at least one outlet port; the injection unit has two sides that are each slidably mounted on a guide rail; the injection unit is also provided, on each of two sides thereof, with a coupling section projecting therefrom; the standing board comprises a first through hole formed therein and the at least one outlet port of the injection unit is received through the first through hole, whereby when the first servomotor is in operation, the screw is rotated and the transmission unit converts rotation of the screw into vertical reciprocal movement;

a gooseneck operation device body, which is mounted on the standing board, the gooseneck operation device body comprising a second servomotor, a first transmission arm, and a second transmission arm, wherein the second servomotor comprises a second speed reduction mechanism; an end of the first transmission arm is formed with a first spindle hole; the second speed reduction mechanism is rotatably coupled, in an eccentric manner, to the first spindle hole; the second transmission arm comprises a rotatable joint section and a transmission section; the rotatable joint section and the transmission section form therebetween a predetermined included angle of 90 degrees; the rotatable joint section is rotatably mounted to an opposite end of the first transmission arm; the transmission section is provided with at least two bifurcation sections and the at least two bifurcation sections are respectively fit over the coupling sections, whereby when the second servomotor is in operation, the first transmission arm and the second transmission arm are driven to cause the transmission section to rotate such that the at least two bifurcation sections are driven to oscillate frontwards and rearwards with the rotation of the transmission section; and a plurality of mold locking device bodies, which are mounted to an opposite surface of the standing board, each of the mold locking device bodies comprising a third servomotor, a third transmission arm, and a mold retention slide block, wherein an end of the third servomotor is provided with a third speed reduction mechanism; the third speed reduction mechanism is rotatably coupled, in an eccentric manner, to the third transmission arm; an opposite end of the third transmission arm is rotatably coupled to the mold retention slide block; one end face of the mold retention slide block is mounted, in a slidable manner, in a mold seat; the mold seat comprises at least two projection sections and a channel is formed between the at least two projection sections; the one end of the mold retention slide block is slidably mounted in the channel; the mold seat is provided with a second through hole that is in communication with the first through hole and the outlet port is received through the second through hole, whereby when the third servomotor is in operation, the third transmission arm is rotated and drives the mold retention slide block to move, such that the mold retention slide block is caused to reciprocate in the channel.

2. The full-servo multi-axis die-casting machine according to claim 1, wherein the first speed reduction mechanism and the one end of the screw are respectively provided with a first fixing element and a second fixing element, such that the first fixing element is coupled to the second fixing element.

3. The full-servo multi-axis die-casting machine according to claim 1, wherein the first frame is provided therein with a separation plate and the separation plate is formed with a first through aperture, the screw extending through the first through aperture, the screw being provided, on an end thereof, with a third fixing element, the third fixing element being coupled to the separation plate, the third fixing element being provided therein with a bearing coupled to the screw.

4. The full-servo multi-axis die-casting machine according to claim 1, wherein the injection unit is provided with a second through aperture to receive an extension of the screw therethrough and the at least one inlet port and the at least one outlet port are respectively formed on a bottom surface and a side of the injection unit.

5. The full-servo multi-axis die-casting machine according to claim 1, wherein the first frame is provided, in a side thereof, with a constraint hole and the transmission unit is provided, on a side thereof, with an engagement section projecting therefrom such that the engagement section is received through the constraint hole.

6. The full-servo multi-axis die-casting machine according to claim 1, wherein an end of the second servomotor, to which the second speed reduction mechanism is mounted, is coupled to a second frame; the second frame is provided, at one side thereof, with a seat plate; the second frame is formed with a third through aperture and the seat plate is provided with a first spindle seat and a second spindle seat; the third through aperture and the first spindle seat receive the second speed reduction mechanism to extend therethrough; the second speed reduction mechanism is coupled to a first eccentric element; an end of the first eccentric element that is coupled to the second speed reduction mechanism is rotatably mounted to the first spindle seat and an opposite end of the first eccentric element is received through the first spindle hole; the first eccentric element is provided, on an end face of said opposite end, with an eccentric shaft extending therethrough; and the eccentric shaft is rotatably mounted to the second spindle seat.

7. The full-servo multi-axis die-casting machine according to claim 1, wherein the transmission section is further provided thereon with two spaced coupling elements and the at least two bifurcation sections are located between the coupling elements such that a predetermined distance is present between the at least two bifurcation sections.

8. The full-servo multi-axis die-casting machine according to claim 1, wherein the third speed reduction mechanism is further provided with a second eccentric element; the second eccentric element has two ends respectively forming a first eccentric section and a second eccentric section; the first eccentric section and the second eccentric section are arranged on the same axial line; the first eccentric section is coupled to the third speed reduction mechanism; the third transmission arm is provided with a second spindle hole formed in an end thereof; and the second eccentric section is mounted in the second spindle hole.

9. The full-servo multi-axis die-casting machine according to claim 1, wherein the third servomotor is coupled to a third frame and the third frame is provided with a fourth through aperture, the fourth through aperture receiving the third speed reduction mechanism to extend therethrough.

10. The full-servo multi-axis die-casting machine according to claim 1, wherein the standing board comprises a first opening and a second opening mounted to a side surface thereof and the standing board is provided therein with a cooling water channel arranged as a loop, the cooling water channel having two ends respectively communicating with the first opening and the second opening, so as to lower down a temperature of the mold seat.

* * * * *